US009946185B2

(12) United States Patent
Furukawa

(10) Patent No.: US 9,946,185 B2
(45) Date of Patent: Apr. 17, 2018

(54) IMAGE FORMING APPARATUS, AND METHOD AND COMPUTER-READABLE MEDIUM FOR THE SAME

(71) Applicant: Brother Kogyo Kabushiki Kaisha, Nagoya-shi, Aichi-ken (JP)

(72) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,049

(22) Filed: Jul. 29, 2016

(65) Prior Publication Data

US 2017/0031261 A1 Feb. 2, 2017

(30) Foreign Application Priority Data

Jul. 31, 2015 (JP) ..... 2015-151729

(51) Int. Cl.

| | |
|---|---|
| ***G03G 15/00*** | (2006.01) |
| ***G03G 15/01*** | (2006.01) |
| ***G03G 15/16*** | (2006.01) |
| ***G03G 21/00*** | (2006.01) |

(52) U.S. Cl.

CPC ..... *G03G 15/0189* (2013.01); *G03G 15/1675* (2013.01); *G03G 21/0011* (2013.01); *G03G 21/0047* (2013.01)

(58) Field of Classification Search

CPC ..... G03G 15/0189; G03G 15/1675; G03G 21/0011; G03G 21/0047

See application file for complete search history.

(56) References Cited

U.S. PATENT DOCUMENTS

| | | | | |
|---|---|---|---|---|
| 4,014,605 | A * | 3/1977 | Fletcher | B65H 5/021 226/94 |
| 4,673,280 | A | 6/1987 | Milton | |
| 6,421,521 | B2 | 7/2002 | Tanaka | |
| 7,787,785 | B2 * | 8/2010 | Kidaka | G03G 15/0258 399/38 |
| 9,383,675 | B2 | 7/2016 | Murayama | |
| 2001/0031160 | A1 | 10/2001 | Tanaka | |

(Continued)

FOREIGN PATENT DOCUMENTS

| | | | |
|---|---|---|---|
| JP | S61-97677 | A | 5/1986 |
| JP | H05-297728 | A | 11/1993 |

(Continued)

*Primary Examiner* — David Bolduc

(74) *Attorney, Agent, or Firm* — Banner & Witcoff, Ltd.

(57) ABSTRACT

An image forming apparatus includes a belt, a first process unit, a second process unit, and a controller configured to form a toner image based on a first pattern on a first photoconductive body of the first process unit. In addition, the controller is configured to transfer the toner image onto the belt, form an electrostatic latent image based on a second pattern on a second photoconductive body of the second process unit such that the electrostatic latent image formed on the second photoconductive body positionally coincides with the toner image transferred onto the belt in a contact position where the second photoconductive body contacts the belt, and convey the electrostatic latent image formed on the second photoconductive body to the contact position without developing the electrostatic latent image with toner.

17 Claims, 8 Drawing Sheets

(56) References Cited

U.S. PATENT DOCUMENTS

2004/0190919 A1* 9/2004 Iwasaki ..... G03G 15/1675 399/45
2005/0100369 A1* 5/2005 Park ..... G03G 21/0011 399/302
2005/0134874 A1* 6/2005 Overall ..... B41J 29/393 358/1.9
2005/0281569 A1* 12/2005 Nishimura ..... G03G 15/1675 399/31
2006/0067742 A1* 3/2006 Hattori ..... G03G 15/0121 399/283
2006/0269316 A1* 11/2006 Kyung ..... G03G 15/0194 399/101
2009/0245829 A1* 10/2009 Hamaya ..... G03G 15/1675 399/50
2009/0297183 A1* 12/2009 Miyahara ..... G03G 15/0131 399/44
2010/0080587 A1* 4/2010 Booth ..... G03G 15/0266 399/44
2010/0303492 A1* 12/2010 Furukawa ..... G03G 15/0131 399/55
2011/0150547 A1* 6/2011 Hirata ..... G03G 21/0011 399/350
2011/0255889 A1* 10/2011 Ogiso ..... G03G 15/0813 399/44
2011/0274452 A1* 11/2011 Fukuyama ..... G03G 15/065 399/43
2011/0293301 A1* 12/2011 Hayakawa ..... G03G 15/1605 399/44
2012/0057891 A1* 3/2012 Ishikura ..... G03G 15/0131 399/55
2012/0141151 A1 6/2012 Yokoyama
2012/0251139 A1* 10/2012 Handa ..... G03G 15/0266 399/44
2013/0028641 A1* 1/2013 Mukai ..... G03G 15/0189 399/308
2013/0251386 A1* 9/2013 Ozeki ..... G03G 15/0258 399/44
2013/0259543 A1* 10/2013 Katagiri ..... G03G 15/5004 399/302
2013/0336669 A1* 12/2013 Fukami ..... G03G 15/5004 399/66
2014/0023384 A1* 1/2014 Hamada ..... G03G 21/0011 399/12
2014/0056604 A1* 2/2014 Hayakawa ..... G03G 15/1675 399/44
2014/0240431 A1 8/2014 Murayama
2014/0321891 A1* 10/2014 Karashima ..... G03G 15/0189 399/314
2014/0356006 A1* 12/2014 Adachi ..... G03G 21/0064 399/50
2016/0124354 A1* 5/2016 Furukawa ..... G03G 15/1675 399/66

FOREIGN PATENT DOCUMENTS

JP H05-297734 A 11/1993
JP 2001-255761 A 9/2001
JP 2006-091458 A 4/2006
JP 2012-123357 A 6/2012
JP 2014-162175 A 9/2014

* cited by examiner

IMAGE FORMING APPARATUS, AND METHOD AND COMPUTER-READABLE MEDIUM FOR THE SAME

CROSS-REFERENCE TO RELATED APPLICATION

This application claims priority under 35 U.S.C. § 119 from Japanese Patent Application No. 2015-151729 filed on Jul. 31, 2015. The entire subject matter of the application is incorporated herein by reference.

BACKGROUND

Technical Field

The following description relates to aspects of an image forming apparatus configured to supply toner from a process unit to another process unit, and a method and a computer-readable medium for controlling the image forming apparatus.

Related Art

As a problem with an electrophotographic image forming apparatus configured to bring a cleaner into contact with a photoconductive body, it has been known that insufficient amount of toner at a contact portion between the photoconductive body and the cleaner is likely to cause an abnormal noise (i.e., so-called "squeaking") due to friction between the photoconductive body and the cleaner. For instance, in an image forming apparatus configured to perform color printing, there may be a case where monochrome printing is consecutively performed with no other toner cartridge but a toner cartridge for monochrome printing being attached to the apparatus. In such a case, no toner image is formed in any process units other than a process unit for monochrome printing. Therefore, in each of the other process units, the contact portion between the photoconductive body and the cleaner is likely to hold little toner.

As an example of techniques for supplying toner to the contact portion between the photoconductive body and the cleaner, the following technique has been known. That is a technique to transfer toner developed on a photoconductive body in a first process unit onto an intermediate transfer belt, and reversely transfer the toner from the intermediate transfer belt to a photoconductive body of a second process unit by applying in the second process unit a reverse transfer bias having a polarity opposite to a polarity of a transfer bias for printing on a sheet.

SUMMARY

However, the known technique has the following problem. That is, the known technique needs a power supply for the reverse transfer bias. Meanwhile, even a simple image forming apparatus without any power supply for the reverse transfer bias may be required to supply toner from a process unit to another process unit.

Aspects of the present disclosure are advantageous to provide one or more improved techniques, for an image forming apparatus, which make it possible to supply toner from a process unit to another process unit of the image forming apparatus, regardless of whether the image forming apparatus includes a power supply for reverse transfer bias.

According to aspects of the present disclosure, an image forming apparatus is provided, which includes a belt, a first process unit including a first photoconductive body, a first charger configured to charge a surface of the first photoconductive body, a first exposurer configured to expose the charged surface of the first photoconductive body thereby forming an electrostatic latent image on the surface of the first photoconductive body, a first developer configured to develop, with toner, the electrostatic latent image formed on the surface of the first photoconductive body thereby forming a toner image on the surface of the first photoconductive body, and a first transferer configured to transfer, onto the belt, the toner image formed on the surface of the first photoconductive body, a second process unit including a second photoconductive body disposed downstream of the first photoconductive body in a moving direction of the belt, a second charger configured to charge a surface of the second photoconductive body, a second exposurer configured to expose the charged surface of the second photoconductive body, a second developer, and a second transferer opposed to the second photoconductive body across the belt in a contact position where the second photoconductive body contacts the belt, and a controller configured to perform a toner supply operation to supply toner from the first process unit to the second process unit, the toner supply operation including controlling the first charger to charge the surface of the first photoconductive body, controlling the first exposurer to expose the charged surface of the first photoconductive body in accordance with a first pattern thereby forming a first electrostatic latent image based on the first pattern on the surface of the first photoconductive body, controlling the first developer to develop the first electrostatic latent image with toner thereby forming a specific toner image based on the first pattern on the surface of the first photoconductive body, controlling the first transferer to transfer the specific toner image onto the belt, controlling the second charger to charge the surface of the second photoconductive body, controlling the second exposurer to expose the charged surface of the second photoconductive body in accordance with a second pattern thereby forming a second electrostatic latent image based on the second pattern on the surface of the second photoconductive body, and controlling the second developer to not develop the second electrostatic latent image with toner, thereby allowing the second electrostatic latent image to be conveyed to the contact position such that the second electrostatic latent image positionally coincides, in the contact position, with the specific toner image transferred onto the belt.

According to aspects of the present disclosure, further provided is a method adapted to be implemented on a processor coupled with an image forming apparatus including a belt, a first process unit, and a second unit, the method including controlling a first charger of the first process unit to charge a surface of a first photoconductive body of the first process unit, controlling a first exposurer of the first process unit to expose the charged surface of the first photoconductive body in accordance with a first pattern thereby forming a first electrostatic latent image based on the first pattern on the surface of the first photoconductive body, controlling a first developer of the first process unit to develop the first electrostatic latent image with toner thereby forming a toner image based on the first pattern on the surface of the first photoconductive body, controlling a first transferer of the first process unit to transfer the toner image onto the belt, controlling a second charger of the second process unit to charge a surface of a second photoconductive body of the second process unit, controlling a second exposurer of the second process unit to expose the charged surface of the second photoconductive body in accordance with a second pattern thereby forming a second electrostatic latent image based on the second pattern on the surface of the second photoconductive body, and controlling a second developer of the second process unit to not develop the second electrostatic latent image with toner, thereby allowing the second electrostatic latent image to be conveyed to the contact position such that the second electrostatic latent image positionally coincides, in the contact position, with the toner image transferred onto the belt.

According to aspects of the present disclosure, further provided is a non-transitory computer-readable medium storing computer-readable instructions that are executable by a processor coupled with an image forming apparatus, the image forming apparatus including a belt, a first process unit, and a second unit, the instructions being configured to, when executed by the processor, cause the processor to control a first charger of the first process unit to charge a surface of a first photoconductive body of the first process unit, control a first exposurer of the first process unit to expose the charged surface of the first photoconductive body in accordance with a first pattern thereby forming a first electrostatic latent image based on the first pattern on the surface of the first photoconductive body, control a first developer of the first process unit to develop the first electrostatic latent image with toner thereby forming a toner image based on the first pattern, on the surface of the first photoconductive body, control a first transferer of the first process unit to transfer the toner image onto the belt, control a second charger of the second process unit to charge a surface of a second photoconductive body of the second process unit, control a second exposurer of the second process unit to expose the charged surface of the second photoconductive body in accordance with a second pattern thereby forming a second electrostatic latent image based on the second pattern on the surface of the second photoconductive body, and control a second developer of the second process unit to not develop the second electrostatic latent image with toner, thereby allowing the second electrostatic latent image to be conveyed to the contact position such that the second electrostatic latent image positionally coincides, in the contact position, with the toner image transferred onto the belt.

BRIEF DESCRIPTION OF THE ACCOMPANYING DRAWINGS

Figure 4:
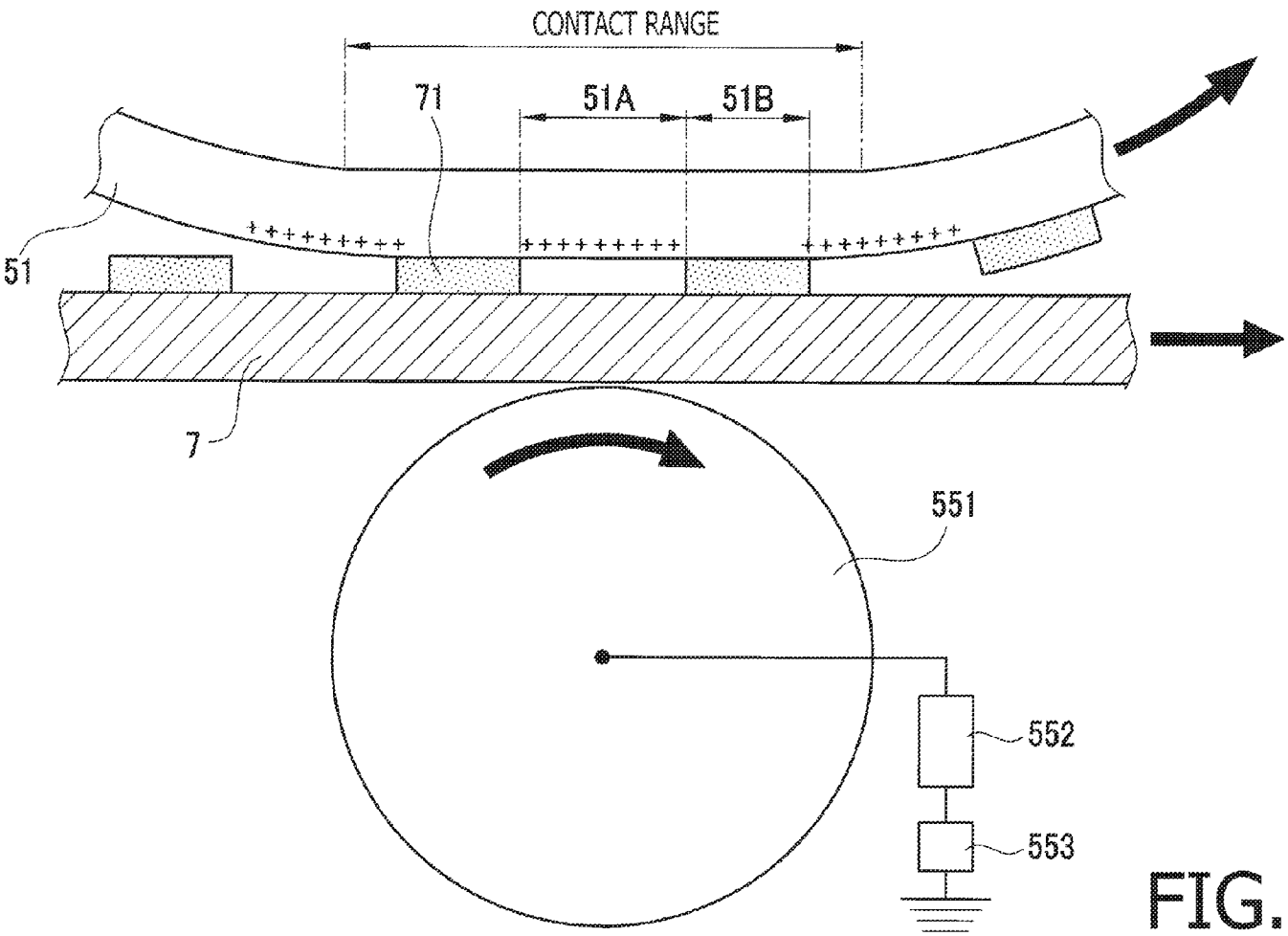

FIG. 4 schematically shows a relationship between a toner image and an electrostatic latent image in a contact range where a conveyance belt contacts a photoconductive body, in the illustrative embodiment according to one or more aspects of the present disclosure.

Figure 5:
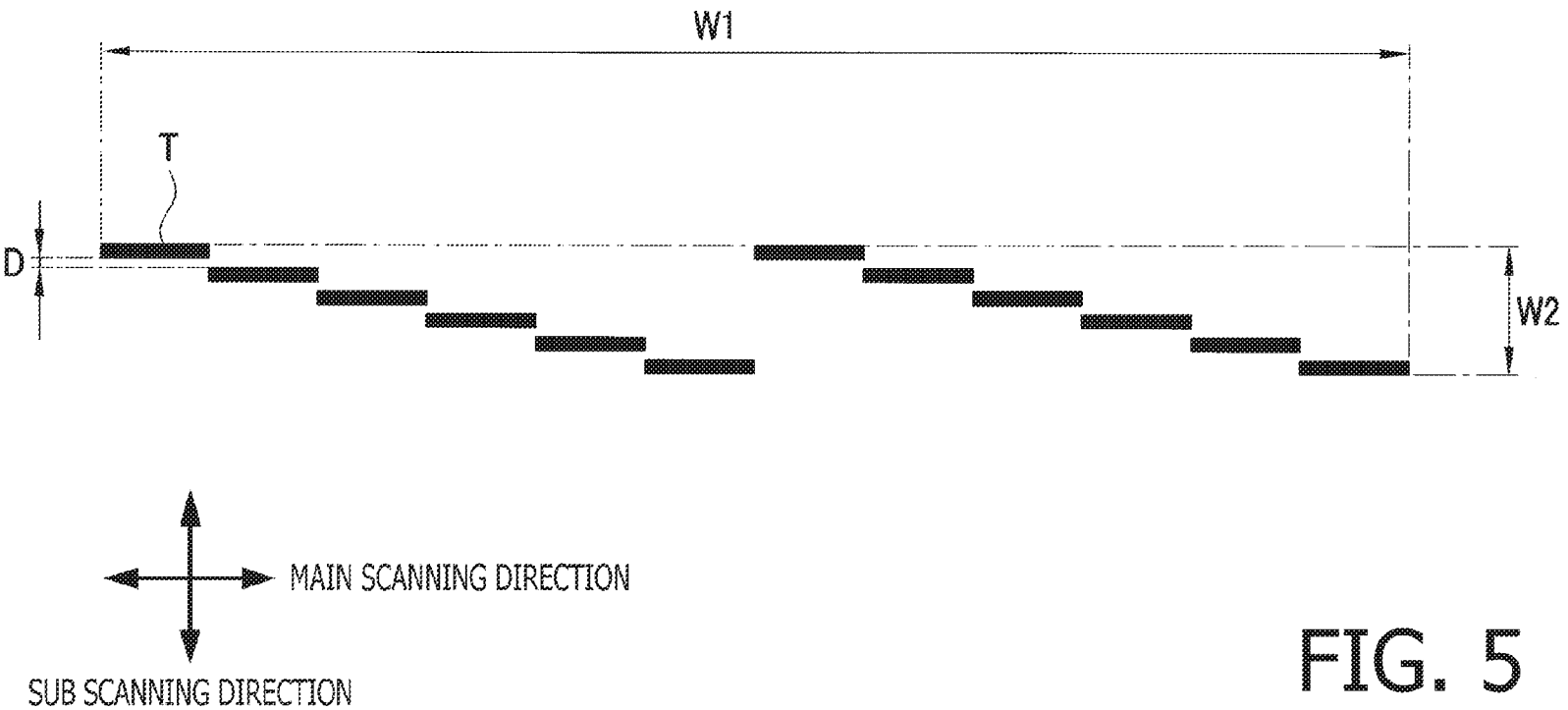

FIG. 5 shows an example of an exposure pattern in the illustrative embodiment according to one or more aspects of the present disclosure.

Figure 6:
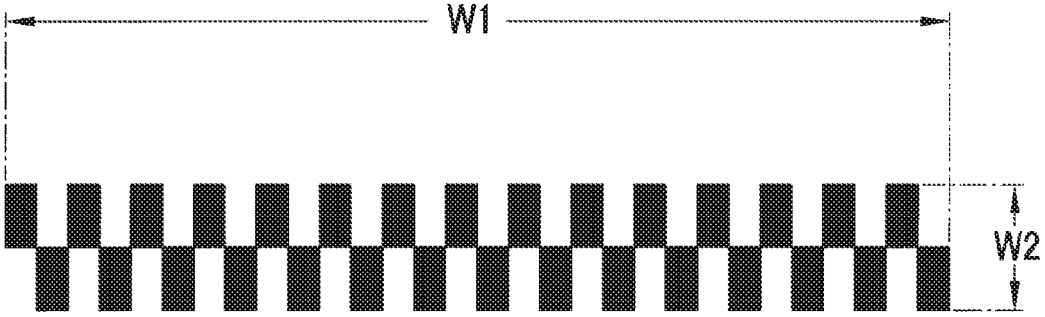

FIG. 6 shows another example of the exposure pattern in the illustrative embodiment according to one or more aspects of the present disclosure.

Figure 7:
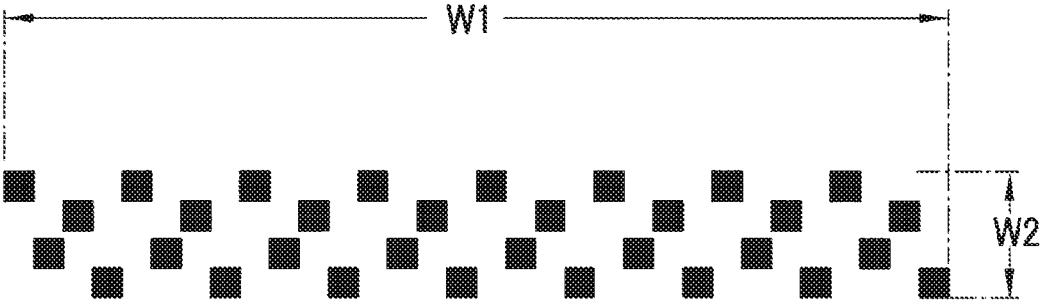

FIG. 7 shows a further example of the exposure pattern in the illustrative embodiment according to one or more aspects of the present disclosure.

Figure 8:
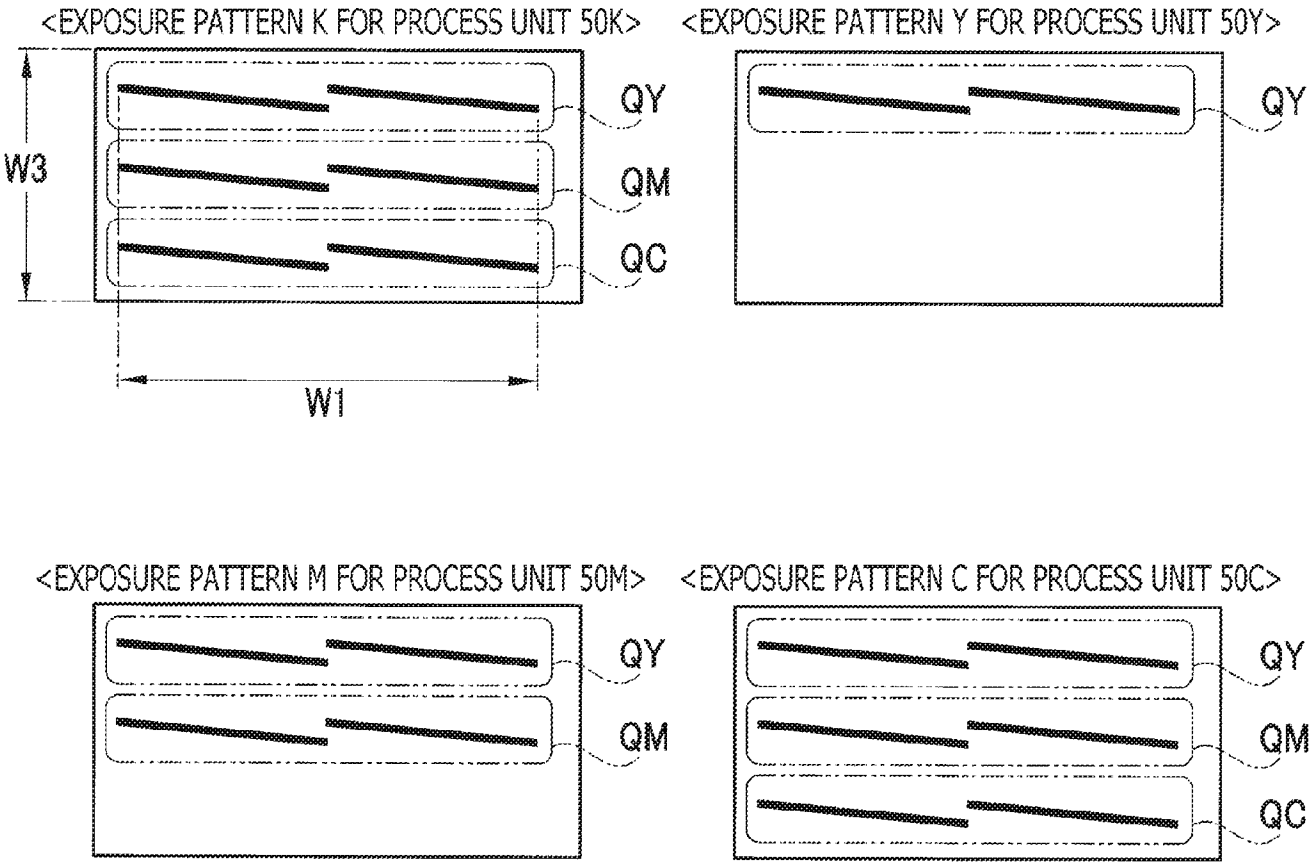

FIG. 8 exemplifies respective exposure patterns for process units for different toner colors in the illustrative embodiment according to one or more aspects of the present disclosure.

Figure 9:
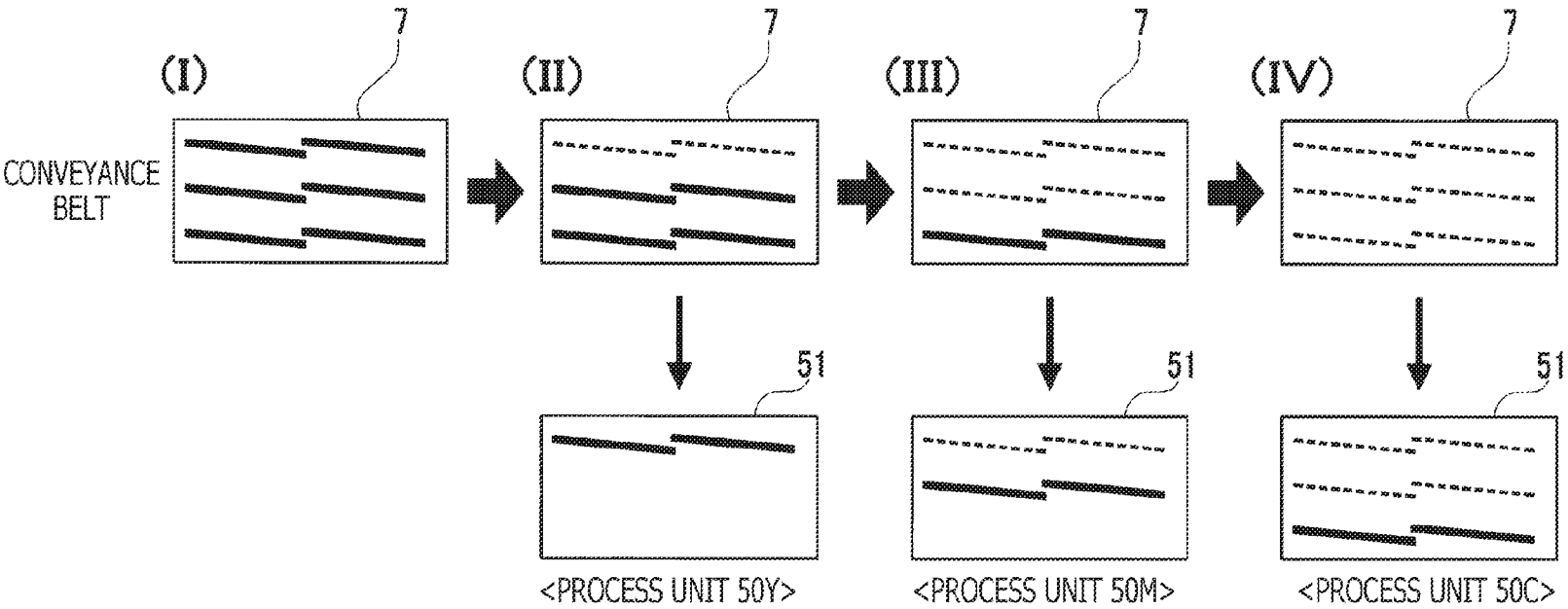

FIG. 9 shows a procedure of a toner supply operation in which toner of a toner image on the conveyance belt is sequentially supplied to each toner supply destination, in the illustrative embodiment according to one or more aspects of the present disclosure.

Figure 10:
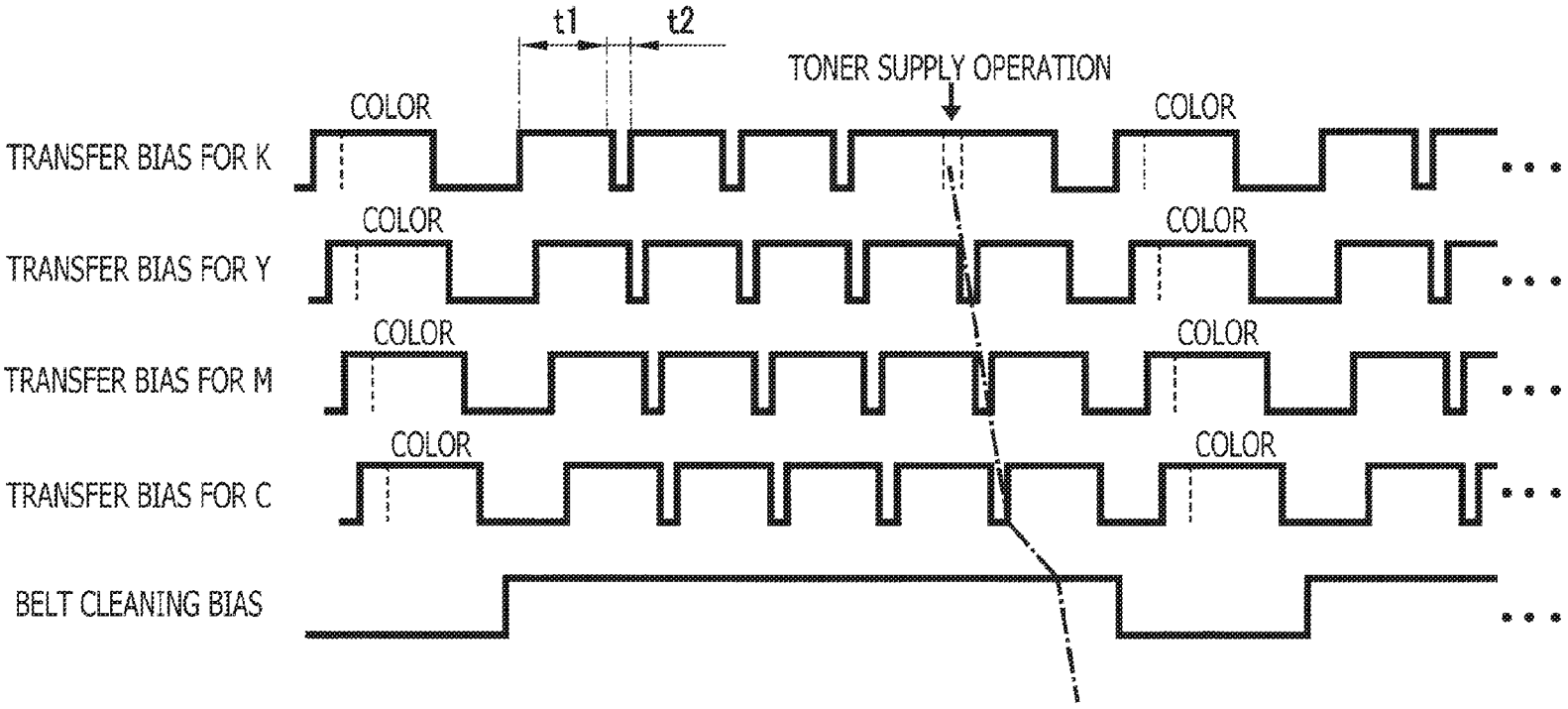

FIG. 10 is a timing chart showing timing for applying a transfer bias to each process unit in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, flexible disks, permanent storage, and the like.

Hereinafter, an illustrative embodiment according to aspects of the present disclosure will be described with reference to the accompanying drawings. In the illustrative embodiment, aspects of the present disclosure are applied to a printer having an image forming function.

Figure 1:
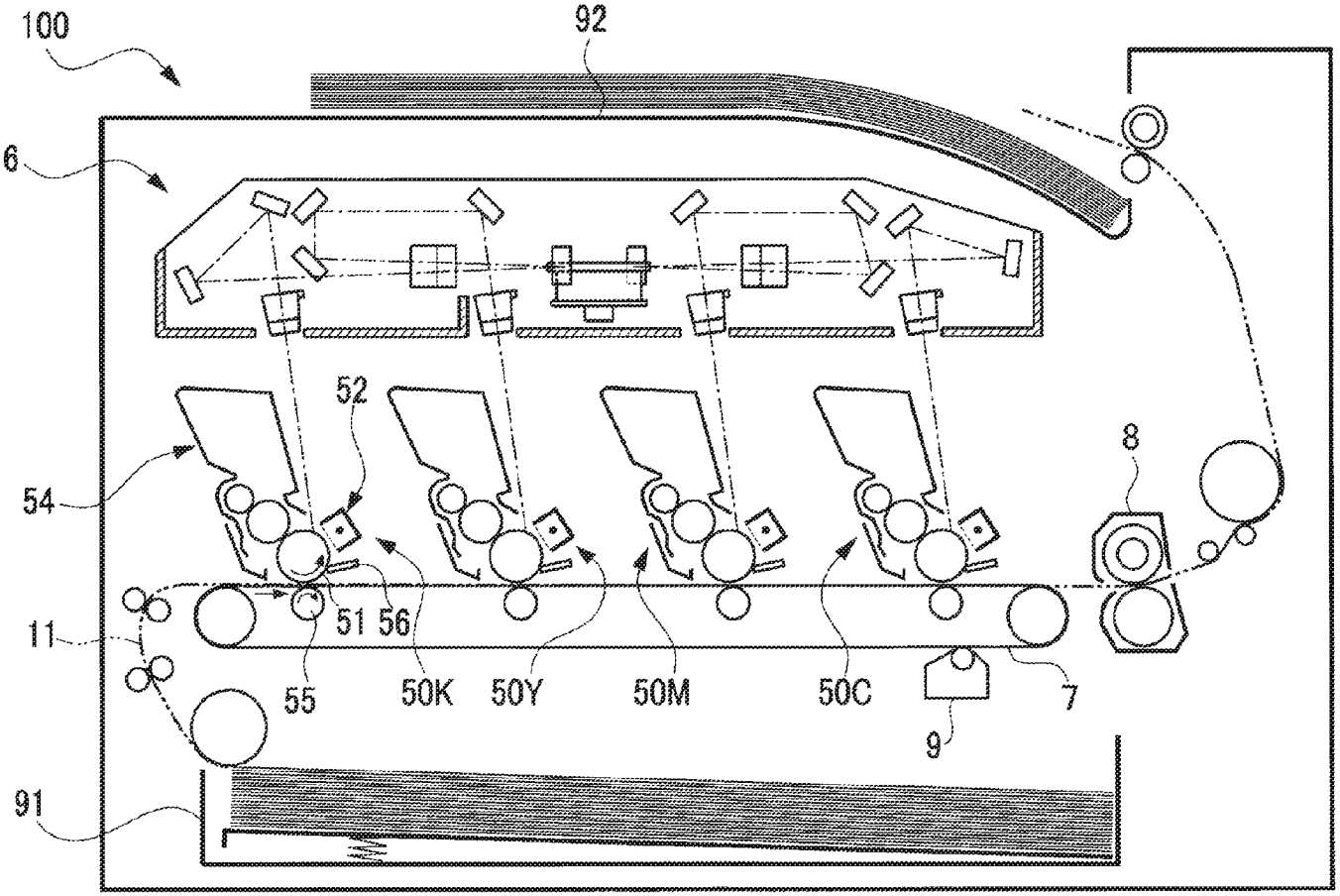
FIG. 1 is a cross-sectional view schematically showing a configuration of a printer in an illustrative embodiment according to one or more aspects of the present disclosure.

A printer 100 of the illustrative embodiment is an electrophotographic color printer. As shown in FIG. 1, the printer 100 includes a process unit 50K for black, a process unit 50Y for yellow, a process unit 50M for magenta, a process unit 50C for cyan, an exposure device 6, a conveyance belt 7, a fuser 8, and a belt cleaner 9. The conveyance belt 7 is an endless belt configured to be rotationally moved by a plurality of rollers. Specifically, the conveyance belt 7 moves clockwise in FIG. 1. The process units 50K, 50Y, 50M, and 50C are arranged along an upper portion of the conveyance belt 7 as shown in FIG. 1. The belt cleaner 9 is disposed to face a lower portion of the conveyance belt 7 as shown in FIG. 1. The belt cleaner 9 is configured to remove substances adhering onto the conveyance belt 7.

Further, the printer 100 includes a feed tray 91 and a discharge tray 92. The feed tray 91 is configured to accommodate a stack of sheets to be printed. The discharge tray 92 is configured to receive and support printed sheets. As indicated by an alternate long and two short dashes line in FIG. 1, a conveyance path 11 is defined in the printer 100. The conveyance path 11 extends from the feed tray 91 to the discharge tray 92 via the upper portion of the conveyance belt 7 shown in FIG. 1. Namely, the upper portion of the conveyance belt 7 shown in FIG. 1 is a part of the conveyance path 11.

In the following description, a moving direction of the conveyance belt 7 within a range regarded as a part of the conveyance path 11, i.e., a direction in which one or more sheets are conveyed in a printing operation may be referred to as a "moving direction" of the conveyance belt 7. The process units 50K, 50Y, 50M, and 50C are arranged in this order in the moving direction of the conveyance belt 7.

Namely, in the printer 100 of the illustrative embodiment, the process unit 50K is disposed the most upstream in the moving direction of the conveyance belt 7, and the other process units 50Y, 50M, and 50C are disposed downstream of the process unit 50K in the moving direction of the conveyance belt 7.

As shown in FIG. 1, the process unit 50K includes a drum-shaped photoconductive body 51, and further includes a charger 52, a developer 54, a transferer 55, and a cleaner 56 that are disposed around the photoconductive drum 51. When there is no sheet being conveyed by the conveyance belt 7, the photoconductive body 51 is in contact with the conveyance belt 7 and rotates in a counterclockwise direction indicated by an arrow in FIG. 1 while the conveyance belt 7 moves in the moving direction. Hereinafter, a range within which the photoconductive body 51 and the conveyance belt 7 are in contact with each other may be referred to as a "contact range."

In an order from the contact range to the downstream in a rotational direction of the photoconductive body 51, a cleaning position, a charge position, an exposure position, and a development position are sequentially defined. The cleaning position is a position where the cleaner 56 contacts the surface of the photoconductive body 51. The charge position is a position where the surface of the photoconductive body 51 is charged by the charger 52. The exposure position is a position where the charged surface of the photoconductive body 51 is exposed by the exposure device 6. The development position is a position where an electrostatic latent image on the surface of the photoconductive body 51 is developed by the developer 54. Further, the transferer 55 is opposed to the photoconductive body 51 across the conveyance belt 7 within the contact range. As indicated by an arrow in FIG. 1, the transferer 55 rotates in a direction (clockwise in FIG. 1) accompanying the movement of the conveyance belt in the moving direction. The other process units 50Y, 50M, and 50C are configured in substantially the same manner as the process unit 50, except for toner colors therefor.

The printer 100 of the illustrative embodiment uses positively-chargeable toner stored in the developer 54. In each of the process units 50K, 50Y, 50M, and 50C, the charger 52 is supplied with a positive charge bias, thereby positively charging a surface of the photoconductive body 51. The exposure device 6 includes a single light source, which is used in common by the process units 50K, 50Y, 50M, and 50C. The exposure device 6 further includes each optical mechanism, such as lenses and mirrors, for each of the process units 50K, 50Y, 50M, and 50C respectively. The single light source is configured to emit a laser beam onto each charged photoconductive body 51 and form an exposed area as a partial area having a reduced electrical potential on each charged photoconductive body 51. Accordingly, on the surface of each charged photoconductive body 51, an electrostatic latent image including the exposed area and an unexposed area is formed. The unexposed area is an area that is not exposed by the exposing device 6 but being charged by the charger 52.

Each developer 54 includes a toner container configured to store colored positively-charged toner. Each developer 54 is configured to develop the electrostatic latent image formed on the corresponding photoconductive body 51, using positively-charged toner, thereby forming a toner image on the photoconductive drum 51. The developer 54 of the process unit 50K stores black toner therein. The developer 54 of the process unit 50Y stores yellow toner therein. The developer 54 of the process unit 50M stores magenta toner therein. The developer 54 of the process unit 50C stores cyan toner therein. In the illustrative embodiment, each developer 54 is detachably attached to a main body of the printer 100. For instance, each developer 54 may be individually attached to the printer 100 in a detachable manner. As another option, the printer 100 may include a drawer configured to support the four developers 54 arranged therein and to be pulled out of the main body of the printer 100. Further, each developer 54 may be detachably attached to the drawer. As a further option, the printer 100 may include multiple drawers each of which is configured to support a corresponding one of the four developers 54. Further, each developer 54 may be detachably attached to a corresponding one of the drawers.

The printer 100 is enabled to perform monochrome printing as long as the developer 54 of the process unit 50K is attached to the printer 100 and is in a developable state, even if each of the developers 54 for the other colors is in an undevelopable state. For instance, the undevelopable state may include a state where the corresponding developer 54 is not attached. Further, the undevelopable state may include a state where even though the corresponding developer 54 is attached, the number of sheets printed using the developer 54 reaches a particular number that is determined based on a storable amount of toner, and therefore a developing operation using the developer 54 is unavailable.

In a printing operation, the printer 100 conveys a sheet set on the feed tray 91, along the conveyance path 11 by a conveyance mechanism including the conveyance belt 7. Then, each transferer 55 is supplied with a negative transfer bias, thereby transferring the toner image formed on the corresponding photoconductive body 51 onto a sheet being conveyed by the conveyance belt 7. Specifically, in color printing, the printer 100 sequentially transfers the toner image formed on each of the respective photoconductive bodies 51 for the four colors onto a sheet, thereby placing the toner image in one color on the toner image in another color. Meanwhile, in monochrome printing, the printer 100 transfers only the black toner image onto a sheet. Further, the printer 100 conveys the sheet with the toner image(s) transferred thereon to the fuser 8. The fuser 8 thermally fixes the toner image(s) onto the sheet. Thereafter, the printer 100 discharges the sheet onto the discharge tray 92.

When there is no sheet conveyed to a position between a photoconductive body 51 and a corresponding transferer 55 (e.g., when a space between adjacent two of sequentially-fed sheets passes through the position), the toner image formed on the photoconductive body 51 comes into contact with the conveyance belt 7 in a contact position corresponding to the transferer 55. The printer 100 is enabled to transfer the toner image formed on the photoconductive body 51 onto the conveyance belt 7 by applying the transfer bias to the transferer 55 at timing when the toner image on the photoconductive body 51 comes into contact with the conveyance belt 7.

Each cleaner 56 comes into contact with the surface of the corresponding photoconductive body 51 that has passed through the contact range, and scrapes toner and other substances remaining on the surface of the photoconductive body 51. For instance, each cleaner 56 includes a cleaning blade made of resin. Each cleaner 56 is fixedly attached to a particular position such that a longer edge of the cleaning blade contacts the surface of the corresponding photoconductive body 51. Further, an effective length of the cleaning blade of each cleaner 56 may be equal to an effective length of the corresponding photoconductive body 51 in an axial direction of the photoconductive body 51 while the toner is supplied to the entire effective length of the photoconductive body 51. Some of the toner scraped by the cleaner 56 may remain in a gap between the cleaner 56 and the photoconductive body 51. The toner remaining in the gap functions as a lubricant between the cleaner 56 and the photoconductive body 51 thereby preventing squeaking. Each cleaner 56 may be configured to contact the photoconductive body 51 at a relative velocity therebetween. For instance, each cleaner 56 may include a cleaning roller, instead of the cleaning blade.

Figure 2:
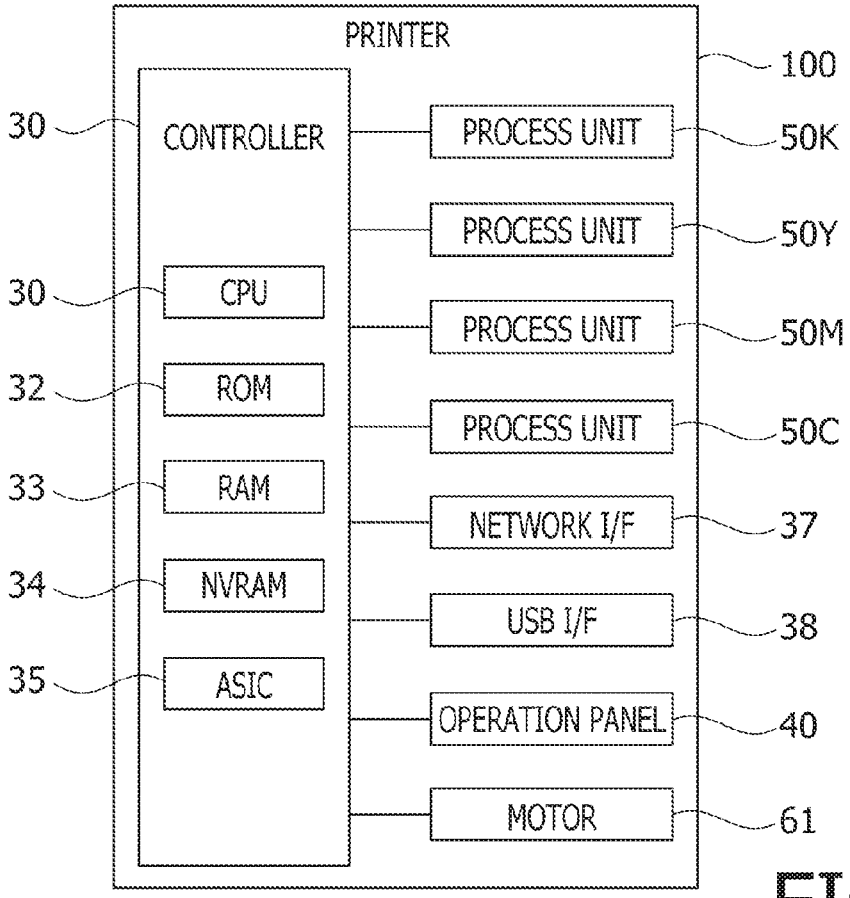
FIG. 2 is a block diagram schematically showing an electrical configuration of the printer in the illustrative embodiment according to one or more aspects of the present disclosure.

Subsequently, an electrical configuration of the printer 100 will be described. As shown in FIG. 2, the printer 100 of the illustrative embodiment includes a controller 30 including a CPU 31, a ROM 32, a RAM 33, an NVRAM 34, and an ASIC 35. Further, the printer 100 includes the process units 50K, 50Y, 50M, and 50C, a network interface 37, a USB interface 38, an operation panel 40, and a motor 61, and these elements are electrically connected with the controller 30.

The ROM 32 stores setting values, initial values, and firmware as control programs for controlling the printer 100. The RAM 33 is used as a work area into which control programs are loaded, or a storage area for temporarily storing image data.

The CPU 31 controls each of elements included in the printer 100 while storing results of the control processing, in accordance with control programs read out from the ROM 32 and signals from sensors. The CPU 31 may be an example of a controller according to aspects of the present disclosure. The controller 30 may be an example of the controller. The ASIC 35 may be an example of the controller. Further, the controller 30 shown in FIG. 2 represents hardware used for controlling the printer 100. Nonetheless, the controller 30 may not necessarily represent a single hardware element actually existing in the printer 100. The controller 30 may include two or more hardware elements.

The network interface 37 is hardware configured to communicate with external devices on a network, e.g., via a LAN cable. The USB interface 38 is hardware configured to communicate with flash memories such as USB memories and external devices, e.g., via a USB cable.

The operation panel 40 is hardware configured to display a notification to the user and accept an input of a user instruction. The operation panel 40 includes a liquid crystal display and buttons such as a start key, a stop key, and a numeric keypad. The motor 61 is configured to output power to rotate the respective photoconductive bodies 51 of the process units 50K, 50Y, 50M, and 50C, a roller for conveying the conveyance belt 7, and a roller of the fuser 8.

Subsequently, a toner supply operation in the printer 100 is described. In monochrome printing, the printer 100 forms a toner image by only using the process unit 50K. Meanwhile, even in monochrome printing, the respective photoconductive bodies 51 of the process units 50Y, 50M, and 50C rotate in the same manner as the photoconductive body 51 of the process unit 50K, and are in contact with the corresponding cleaners 56. Therefore, in each of the process units 50Y, 50M, and 50C, the amount of toner, which remains at a contact portion between the cleaner 56 and the photoconductive body 51 and serves as a lubricant therebetween, tends to decrease as monochrome printing is repeatedly performed unless color printing is performed.

Further, in the illustrative embodiment, even if the respective developers 54 of the process units 50Y, 50M, and 50C other than the process unit 50K are not attached, the printer 100 is enabled to perform monochrome printing. In each of the process units 50Y, 50M, and 50C from which the respective developers 54 thereof are detached, even though the amount of toner at the contact portion between the cleaner 56 and the photoconductive body 51 is reduced, no toner is supplied to the contact portion.

Therefore, the printer 100 of the illustrative embodiment performs a toner supply operation of supplying black toner from the process unit 50K to each of the process units 50Y, 50M, and 50C for the other colors whereby the black toner functions as a lubricant for the process units 50Y, 50M and 50C. In the toner supply operation, the process unit 50K is a toner supply source. Further, each of the process units 50Y, 50M, and 50C is a toner supply destination.

The toner supply operation for supplying toner from the process unit 50K to the process unit 50Y will be described with reference to FIG. 3. Firstly, in the process unit 50K, the printer 100 forms a toner image based on a predetermined exposure pattern, and transfers the formed toner image onto the conveyance belt 7. It is noted that the predetermined exposure pattern is previously stored in the ROM 32 or the NVRAM 34 of the printer 100. The exposure pattern will be described later.

Figure 3:
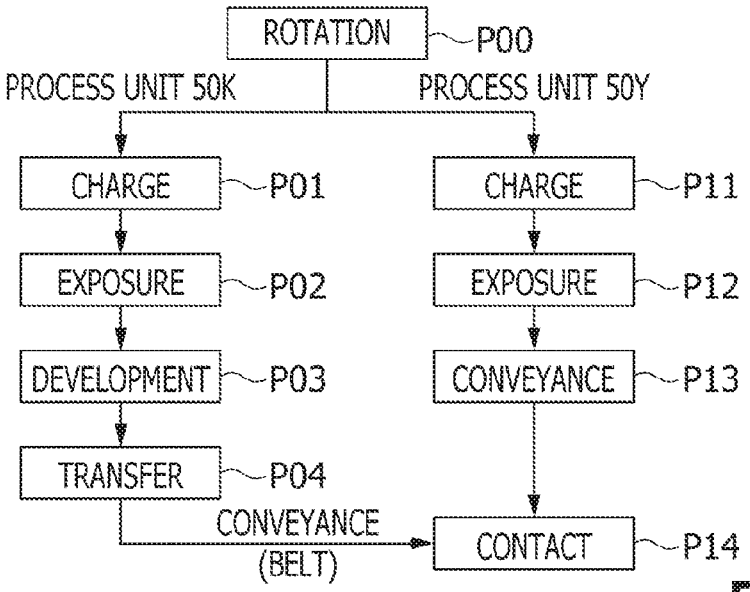
FIG. 3 shows a procedure for supplying toner from a toner supply source to a toner supply destination in the printer in the illustrative embodiment according to one or more aspects of the present disclosure.

Specifically, as shown in FIG. 3, firstly in a rotation process P00, the printer 100 (more specifically, the controller 30) drives the motor 61 to start rotating the photoconductive body 51 of the process unit 50K, the photoconductive body 51 of the process unit 50Y, and the conveyance belt 7.

Then, in the process unit 50K, the printer 100 (more specifically, the controller 30) sequentially performs a charge process P01, an exposure process P02, and a development process P03. In the charge process P01, the printer 100 controls the charger 52 of the process unit 50K to positively charge the photoconductive body 51. In the exposure process P02, the printer 100 controls the exposure device 6 to expose the positively-charged photoconductive body 51 of the process unit 50K based on the predetermined exposure pattern and form an electrostatic latent image on the photoconductive body 51 of the process unit 50K. In the development process P03, the printer 100 controls the developer 54 to supply black toner to the formed electrostatic latent image and form a black toner image. Thereby, the black toner image is formed on the photoconductive body 51 of the process unit 50K.

Further, the printer 100 (more specifically, the controller 30) performs a transfer process P04 of transferring the black toner image formed on the photoconductive body 51 of the process unit 50K onto the conveyance belt 7. More specifically, in the transfer process P04, the printer 100 applies a transfer bias to the transferer 55 of the process unit 50K at such timing that there exists no sheet in the contact range of the process unit 50K (e.g., at such timing that the space between two sequentially-fed sheets exists in the contact range of the process unit 50K). The conveyance belt 7 has begun to move in the rotation process P00. Therefore, in the transfer process P04, the printer 100 transfers the black toner image onto the conveyance belt 7. Thereby, the black toner image is conveyed toward the process unit 50Y as the conveyance belt 7 approaches the process unit 50Y.

Further, in the process unit 50Y, the printer 100 (more specifically, the controller 30) performs the charge process P11 and the exposure process P12. In the charge process P11, the printer 100 controls the charger 52 of the process unit 50Y to positively charge the photoconductive body 51 of the process unit 50Y. In the exposure process P12, the printer 100 controls the exposure device 6 to expose the positively-charged photoconductive body 51 of the process unit 50Y based on a predetermined exposure pattern for the toner supply destination. Thereby, an electrostatic latent image is formed on the photoconductive body 51 of the process unit 50Y. The predetermined exposure pattern for the toner supply destination is stored in the ROM 32 or the NVRAM 34.

As described above, in the rotation process P00, the photoconductive body 51 of the process unit 50Y has begun to rotate. Therefore, the electrostatic latent image formed on the photoconductive body 51 of the process unit 50Y is conveyed to the contact range where the conveyance belt 7 contacts the photoconductive body 51 of the process unit 50Y contact each other. It is noted that, in FIG. 3, a process of conveying the electrostatic latent image by rotation of the photoconductive body 51 of the process unit 50Y is referred to as a conveyance process P13.

In the conveyance process P13, the printer 100 (more specifically, the controller 30) controls the developer 54 not to develop the electrostatic latent image formed on the photoconductive body 51 of the process unit 50Y. For instance, the printer 100 may not apply a development bias to the developer 54 of the process unit 50Y. As another option, the printer 100 may be in an undevelopable state such as a state where the developer 54 of the process unit 50Y is not attached, a state where the number of developing operations by the developer 54 of the process unit 50Y reaches a predetermined number, and a state where a development roller is separated from the photoconductive body 51 of the process unit 50Y.

Along with movement of the conveyance belt 7, the black toner image on the conveyance belt 7 arrives in the contact range of the process unit 50Y. Further, the electrostatic latent image is formed on the photoconductive body 51 of the process unit 50Y in such a manner that when the black toner image on the conveyance belt 7 arrives in the contact range of the process unit 50Y, the black toner image on the conveyance belt 7 is positionally coincident with the electrostatic latent image on the photoconductive body 51 of the process unit 50Y. Thereby, the printer 100 brings the electrostatic latent image on the photoconductive body 51 of the process unit 50Y into contact with the black toner image on the conveyance belt 7 in the contact range of the process unit 50Y. In FIG. 3, a process of bringing the electrostatic latent image on the photoconductive body 51 of the process unit 50Y into contact with the black toner image on the conveyance belt 7 is referred to as a contact process P14.

Namely, the printer 100 (more specifically, the controller 30) causes the exposed area formed in the exposure process P12 and the black toner image transferred onto the conveyance belt 7 in the transfer process P04 to concurrently arrive in the contact range of the process unit 50Y. Specifically, the printer 100 controls the exposure device 6 to start forming the electrostatic latent image on the photoconductive body 51 of the process unit 50Y at particular timing after starting forming the electrostatic latent image on the photoconductive body 51 of the process unit 50K. It is noted that this process by the exposure device 6 is substantially the same as a process for positioning a plurality of toner images in color printing. Thus, the process by the exposure device 6 is accomplished by positioning two exposed patterns such that one exposure pattern is positionally coincident with the other exposed pattern.

FIG. 4 exemplifies a relationship between a toner image and an electrostatic latent image in a contact range. More specifically, FIG. 4 is a cross-sectional view in an axial direction of the photoconductive body 51 of the process unit 50Y, schematically showing the contact range within which the conveyance belt 7 contacts the photoconductive body 51 of the process unit 50Y and neighboring regions around the contact range. A width shown as the contact range in FIG. 4 corresponds to a width of a nip between the photoconductive body 51 and the conveyance belt 7. The photoconductive body 51, a transfer roller 551 of the transferer 55, and the conveyance belt 7 are moving or rotating in directions indicated by arrows in FIG. 4, respectively. The photoconductive body 51 is formed in a cylindrical shape having a diameter larger than a diameter of the transfer roller 551. FIG. 4 shows only a part of the photoconductive body 51.

On the surface of the photoconductive body 51 of the process unit 50Y are an unexposed area 51A and an exposed area 51B. The unexposed area 51A has an electrical potential equivalent to an electrical potential of the charged surface of the photoconductive body 51. The exposed area 51B has a reduced electrical potential due to exposing the charged surface of the photoconductive body 51. The unexposed area 51A is indicated by symbols "+" in FIG. 4. FIG. 4 exemplifies a pattern with the unexposed areas 51A and the exposed areas 51B alternately arranged along a circumferential direction of the photoconductive body 51. In a boundary between the unexposed area 51A and the exposed area 51B on the surface of the photoconductive body 51, an electric field is formed due to an electrical potential difference. The formed electric field is directed from the unexposed area 51A toward the exposed area 51B. Then, when coming into contact with the photoconductive body 51, toner of a toner image 71 on the conveyance belt 7 is attracted by the exposed area 51B on the photoconductive body 51, due to a so-called edge effect under the formed electric field.

Further, as shown in FIG. 4, a shaft of the transfer roller 551 is grounded via a constant-voltage element 552 and a power supply 553. Examples of the constant-voltage element 552 may include a Zener diode and a varistor. The constant-voltage element 552 is configured to stabilize an electrical potential of the transfer roller 551 when the transfer bias is not applied to the transfer roller 551. The power supply 553 is configured to apply the transfer bias to the transfer roller 551. It is noted that, in the toner supply operation, the printer 100 (more specifically, the controller 30) controls the power supply 553 not to apply the transfer bias to the transfer roller 551.

In the toner supply operation, a low electric current flows from the unexposed area 51A of the photoconductive body 51 and the positively-charged toner through the transfer roller 551 and the OFF-state power supply 553. Thereby, a surface potential of the transfer roller 551 is increased. Especially, in the printer 100 of the illustrative embodiment, the surface potential of the transfer roller 551 is increased even by the low electric current, owing to the constant-voltage element 552 connected in series with the power supply 553. The increase of the surface potential of the transfer roller 551 enlarges an electrical potential difference between the surface potential of the transfer roller 551 and the electrical potential of the unexposed area 51A on the photoconductive body 51. Thereby, a larger electric field is formed, and the larger electric field causes the black toner to be more easily transferred from the conveyance belt 7 to the photoconductive body 51.

In the transfer process P04 for the process unit 50K, it is preferable to apply, as the transfer bias, a less transfer current or a transfer voltage having a less absolute value than when printing is performed on a sheet. Thereby, the transferred toner may be less charged than when printing is performed on a sheet, and the toner may be more easily movable to the photoconductive body 51 by the electric field formed in the toner supply operation. Further, in the printer 100, the constant-voltage element 552 such as a Zener diode is used. The use of the constant-voltage element 552 has a smaller influence on a toner transfer operation for printing on a sheet than when a resistor is used.

Namely, in the printer 100 of the illustrative embodiment, even though a reverse transfer bias is not applied, the edge effect of the electric field in the boundary between the unexposed area 51A and the exposed area 51B and the increase in the surface potential of the transfer roller 551 due to a low electric current may cause the toner to be transferred from the conveyance belt to the photoconductive body 51. Then, some toner of the black toner image on the conveyance belt 7 is transferred and attached onto the photoconductive body 51 of the process unit 50Y. Further, in the printer 100, the photoconductive body 51 of the process unit 50Y is rotated, and toner adhering onto the photoconductive body 51 is scraped by the cleaner 56. Thereby, toner is supplied as a lubricant to the contact portion between the cleaner 56 and the photoconductive body 51 in the process unit 50Y.

In the toner supply operation, the printer 100 of the illustrative embodiment is not required to apply a reverse transfer bias to the transferer 55 of the process unit 50Y. Since the printer 100 does not need to apply a reverse transfer bias, it is possible to achieve reduced electric power consumption and simple control for the printer 100. Further, there is no need for an extra power supply for reverse transfer bias. Namely, the toner supply operation of the illustrative embodiment is particularly suitable for the printer 100 that does not have a power supply for reverse transfer bias.

In the case of a printer having an extra power supply for reverse transfer bias, the reverse transfer bias may be applied to the transferer 55. The reverse transfer bias may cause the toner to be more easily transferred to the photoconductive body 51, on which the electrostatic latent image is formed in the exposure process P12.

Subsequently, the exposure pattern used for the toner supply operation by the printer 100 is described. The exposure pattern used for the exposure process P02 in the process unit 50K is a first exposure pattern. In addition, the exposure pattern used for the exposure process P12 in the process unit 50Y is a second exposure pattern.

Firstly, the second exposure pattern will be described. In order to efficiently use the aforementioned edge effect, the second exposure pattern is desired to have a lot of edge portions. Specifically, the second exposure pattern may be desired to have one or more unexposed areas 51A and one or more exposed areas 51B be within the contact range on the surface of photoconductive body 51 when the surface of the photoconductive body 51 is exposed based on the second exposure pattern. The second exposure pattern may be further desired to have a total width of the unexposed areas 51A be equal to or more than a total width of the exposed areas 51B in a main scanning direction. Additionally, the second exposure pattern for the toner supply destination may be further desired to have each individual exposed area 51B be less than the width of the nip between the photoconductive body 51 and the conveyance belt 7, in a sub scanning direction.

FIG. 5 shows an example of the second exposure pattern. In FIG. 5, the exposed areas 51B are shown as areas filled in black. The whole exposure pattern has a width W1 in the main scanning direction and a width W2 in the sub scanning direction. The width W1 corresponds to an entire length within which the toner image is allowed to be formed in the main scanning direction. The width W2 is less than the space between two sequentially-fed sheets in the sub scanning direction. Since the second exposure pattern extends for the width W1 in the main scanning direction, it is highly likely that toner is supplied to the whole contact portion between the cleaner 56 and the photoconductive body 51. Further, a total length of the exposed areas 51B in the sub scanning direction is a constant value with regard to the whole width W1 in the main scanning direction. Therefore, the toner is supplied to the surface of the photoconductive body 51 quite evenly in the main scanning direction.

Specifically, the second exposure pattern shown in FIG. 5 includes six rectangles T each elongated in the main scanning direction are arranged in a terraced manner without any gaps or overlaps in the main scanning direction. A group of the six rectangles T arranged in the terraced manner in the main scanning direction is repeated twice in the main scanning direction. In the example shown in FIG. 5, a width of each rectangle T in the main scanning direction is one twelfth of the width W1. Further, a width of each rectangle T in the sub scanning direction is less than the width of the nip as the contact range where the photoconductive body 51 contacts the conveyance belt 7. For instance, the width of each rectangle T in the sub scanning direction may be as large as 5 to 10 dots. Since the width of each rectangle T in the sub scanning direction is less than the contact range where the photoconductive body 51 contacts the conveyance belt 7, the photoconductive body 51 is allowed to concurrently contact two or more edges of the rectangles T. Thus, it is possible to secure an adequate amount of toner supplied to the photoconductive body 51 of the process unit 50Y, 50M and 50C.

As shown in FIG. 5, the second exposure pattern has a gap D between two adjacent rectangles T in the sub scanning direction within a single group of the six rectangles T. The gap D is less than the width of each rectangle T in the sub scanning direction. The gap D is as wide as 2 to 5 dots. Since the gap D is provided between two adjacent rectangles T in the sub scanning direction, corner edges of each rectangular T are formed more clearly. Thus, it is possible to secure a more adequate amount of toner supplied to the photoconductive body 51 of the process unit 50Y, 50M and 50C.

Further, in each row of the second exposure pattern shown in FIG. 5 in the main scanning direction, two rectangles T are spaced apart from each other. Additionally, in the main scanning direction, a total width of the unexposed areas 51A is equal to or more than a total width of the exposed areas 51B. A greater width of the unexposed areas 51A are likely to cause a larger electric current flowing through the transferer 55 such that toner is more easily transferred from the conveyance belt 7 to the photoconductive body 51.

Namely, the second exposure pattern is desired to have, in the sub scanning direction, a total width of the unexposed areas 51A be equal to or more than a total width of the exposed areas 51B within the width of the nip as the contact range where the photoconductive body 51 contacts the conveyance belt 7. More preferably, in each single exposure line having an entire length of the second exposure pattern in the main scanning direction and a width of a single dot in the sub scanning direction, one or more unexposed areas 51A and one or more exposed areas 51B may be together contained. In particular, preferably, a plurality of exposed areas 51B may be spaced apart from each other in the main scanning direction in each single exposure line. Further preferably, in each single vertical line having an entire length of the exposure pattern in the sub scanning direction and a width of a single dot in the main scanning direction, one or more unexposed areas 51A and one or more exposed areas 51B may be together contained. In particular, preferably, a plurality of exposed areas 51B may be spaced apart from each other in the sub scanning direction in each single vertical line.

As described above, the second exposure pattern of the illustrative embodiment includes a group of the six rectangles T arranged in the terraced manner in the main scanning direction and the group is repeated twice in the main scanning direction. Nonetheless, the group of the six rectangles T arranged in the terraced manner in the main scanning direction may be repeated three or more times in the main scanning direction. Further, the second exposure pattern may have only a single group of the six rectangles T arranged in the terraced manner without any gaps or overlaps in the main scanning direction within the width W1, without the group of the six rectangles T being repeated in the main scanning direction within the width W2. Furthermore, the exposure pattern may include one or more groups each having two or more rectangles T arranged in the terraced manner in the main scanning direction.

Subsequently, the first exposure pattern will be described. In order to supply an adequate amount of toner to the second exposure pattern formed on the surface of the photoconductive body 51 of the process unit 50Y, 50M, and 50C, it is preferable that the black toner image is formed in such a position as to contact the exposed areas 51B on the surface of the photoconductive body 51 of the process unit 50Y, 50M and 50C on the conveyance belt 7. Namely, the first exposure pattern is required to include at least overlap portions positionally coincident with the second exposure pattern. In particular, the first exposure pattern is desired to include the second exposure pattern.

For instance, the first exposure pattern may include the same exposed areas as the second exposure pattern. When the exposed areas in the first exposure pattern are formed in substantially the same shape as the exposed areas in the second exposure pattern, it would cause the toner to be supplied efficiently from the toner supply source to the toner supply destination and would cause the waste toner to be minimal. Further, in the development process P03 for the process unit 50K, the aforementioned edge effect occurs. Therefore, when the first exposure pattern is formed in substantially the same manner as the second exposure pattern exemplified in FIG. 5, the first exposure pattern has a combination of a plurality of elongated rectangles arranged with the gap D so as to cause the edge effect. Thus, in comparison with a pattern filled within the range defined by "W1×W2," the first exposure pattern is likely to receive a larger amount of toner per unit area of the toner image. Hence, as the first exposure pattern receives a larger amount of toner per unit area of the toner image, it is likely that a larger amount of toner is supplied to the photoconductive body 51 of the process unit 50Y, 50M and 50C.

More preferably, in the development process P03 for the process unit 50K, a development bias having an electric potential with a larger absolute value is desired to be applied than when printing is performed on a sheet. The development bias with the larger absolute value is likely to cause a larger amount of toner per unit area of the toner image and a thicker toner image. Consequently, the development bias with the larger absolute value is likely to cause a larger amount of toner supplied to the photoconductive body 51 of the process unit 50Y, 50M and 50C.

The first exposure pattern may have wider exposed areas than the second exposure pattern. In this case, even though there is a positional difference caused between the toner supply source and the toner supply destination, toner is more likely to be supplied from the toner supply source to the toner supply destination. For instance, the first exposure pattern may be a pattern filled within the range defined by "W1×W2." Further, for instance, the first exposure pattern may cause each exposed area of the second exposure pattern for the toner supply destination to be greater by a particular width (e.g., a width of one or two dots) in each direction along the sub scanning direction.

The second exposure pattern and the first exposure pattern are not limited to the one exemplified in FIG. 5. For instance, the second exposure pattern and/or the first exposure pattern may include a repeat of a particular pattern or a combination of two or more particular patterns. The examples of the particular patterns may include a vertical stripe pattern exemplified in FIG. 6, a dot pattern exemplified in FIG. 7, and a checkerboard pattern formed by a combination of vertical stripes and horizontal stripes. Another example of the particular patterns may include a horizontal stripe pattern, which has a plurality of horizontal stripe lines that are elongated in the main scanning direction and widely spaced apart from each other in the sub scanning direction such that the unexposed areas 51A are sufficiently wider than the exposed areas 51B within the contact range. Further, the RAM 33 and/or NVRAM 34 of the printer 100 may store a plurality of types of exposure patterns, and may select and use an appropriate one of the plurality of types of exposure patterns in accordance with a necessary amount of toner to be supplied.

Subsequently, an explanation will be provided of a toner supply operation of supplying toner to not only the process unit 50Y but all of the process units 50Y, 50M, and 50C. As described above, the process units 50K, 50Y, 50M, and 50C are arranged in the above-cited order in the moving direction of the conveyance belt 7. Therefore, for instance, when a black toner image formed in the process unit 50K arrives to the photoconductive body 51 of the process unit 50M, the toner image should have passed by the process unit 50Y. When the toner supply destination is the process unit 50M, toner of the black toner image is desired not to be transferred to the photoconductive body 51 of the process unit 50Y when passing by the process unit 50Y.

In the printer 100 of the illustrative embodiment, respective different exposure patterns are used for the process units 50K, 50Y, 50M, and 50C. Thereby, black toner is sequentially supplied to each of the process units 50Y, 50M, and 50C when a single space between two sequentially-fed sheets sequentially passes through the contact range of each of the process units 50Y, 50M, and 50C. Specifically, as shown in FIG. 8, the process units 50Y, 50M, and 50C use respective different exposure patterns. The process unit 50K uses an exposure pattern containing all of the exposure patterns for the process units 50Y, 50M, and 50C.

In FIG. 8, an exposure pattern QY is for supplying black toner to the process unit 50Y. An exposure pattern QM is for supplying black toner to the process unit 50M. An exposure pattern QC is for supplying black toner to the process unit 50C. For instance, each of the exposure patterns QY, QM, and QC is a terraced exposure pattern as shown in FIG. 5. In FIG. 8, each terraced exposure pattern is shown as slanted lines for the sake of simplicity. The exposure patterns QY, QM, and QC may be completely identical to each other. Alternatively, the exposure patterns QY, QM, and QC may be slightly different from each other. Each of the exposure patterns QY, QM, and QC may have a plurality of rectangles T arranged in a different manner from the other two exposure patterns.

As shown in FIG. 8, the exposure pattern K for the process unit 50K is a combination of the exposure patterns QY, QM, and QC arranged not to overlap each other in the sub scanning direction. The exposure pattern K is entirely within a range defined by the width W1 in the main scanning direction and a width equal to or less than a width W3 in the sub scanning direction. The width W3 represents a width of the space between two sequentially-fed sheets in the sub scanning direction. As shown in FIG. 8, the exposure pattern Y for the process unit 50Y contains the exposure pattern QY, and does not contain the exposure pattern QM and the exposure pattern QC. The exposure pattern M for the process unit 50M contains the exposure patterns QY and QM, and does not contain the exposure pattern QC. The exposure pattern C for the process unit 50C contains the exposure patterns QY, QM, and QC.

When a toner supply operation is performed using the exposure patterns K, Y, M and C shown in FIG. 8, as shown in FIG. 9, toner is supplied to the photoconductive body 51 of each of the process units 50Y, 50M, and 50C. At a first stage (I) shown in FIG. 9, a black toner image corresponding to the exposure patterns QY, QM, and QC is formed on the conveyance belt 7 by the process unit 50K. The formed toner image is conveyed by the conveyance belt 7 toward the process unit 50Y.

The toner image on the conveyance belt 7 comes into contact with the photoconductive body 51 of the process unit 50Y in the contact range of the process unit 50Y. The photoconductive body 51 of the process unit 50Y has been exposed in accordance with the exposure pattern Y containing the exposure pattern QY (see FIG. 8). Accordingly, most toner of the black toner image formed in accordance with the exposure pattern QY is transferred onto the photoconductive body 51 of the process unit 50Y. It results in a reduced amount of toner in positions corresponding to the exposure pattern QY on the conveyance belt 7 at a second stage (II) shown in FIG. 9.

Meanwhile, the exposure pattern Y does not contain the exposure pattern QM or the exposure pattern QC. Therefore, toner of the black toner image formed in accordance with the exposure patterns QM and QC by the process unit 50K comes into contact with the unexposed areas 51A on the photoconductive body 51 of the process unit 50Y. Since the unexposed areas 51A have a higher electrical potential, the toner that comes into contact with the unexposed areas 51A is not allowed to be easily transferred onto the photoconductive body 51. Accordingly, even though the toner of the toner image formed in accordance with the exposure patterns QM and QC comes into contact with the photoconductive body 51 of the process unit 50Y, only very little toner may be transferred onto the photoconductive body 51. Thereby, the toner of the black toner image formed in accordance with the exposure patterns QM and QC passes by the process unit 50Y and remains onto the conveyance belt 7 while conveyed towards the process unit 50M.

Further, for a period of time when the black toner image formed in accordance with the exposure patterns QM and QC are passing by the process unit 50Y, the printer 100 (more specifically, the controller 30) may apply to the transferer 55 of the process unit 50Y a transfer bias having the same polarity as and a less absolute value than when printing is performed on a sheet. Alternatively, for the above period of time, the printer 100 may apply to the transferer 55 of the process unit 50Y a transfer current less than a transfer current for printing on a sheet. By applying such transfer bias, the electrical potential of the transfer roller 551 does not rise, and then the toner of the black toner image formed in accordance with the exposure patterns QM and QC is not likely to be transferred onto the photoconductive body 51 of the process unit 50Y.

Accordingly, the toner of the black toner image formed in accordance with the exposure patterns QM and QC is not transferred onto the photoconductive body 51 of the process unit 50Y, and is further conveyed while remaining onto the conveyance belt 7.

The black toner image on the conveyance belt 7 is further conveyed from the contact range of the process unit 50Y, and comes into contact with the photoconductive body 51 of the process unit 50M in the contact range of the process unit 50M. At this time, the photoconductive body 51 of the process unit 50M has been exposed in accordance with the exposure pattern M for the process unit 50M containing the exposure patterns QY and QM (see FIG. 8). Accordingly, most toner of a black toner image formed in accordance with the exposure pattern QM is transferred onto the photoconductive body 51 of the process unit 50M.

Further, some toner remaining on the conveyance belt 7 corresponding to the exposure pattern QY even after contacting the photoconductive body 51 of the process unit 50Y also comes into contact with the photoconductive body 51 of the process unit 50M. Additionally, the exposure pattern M for the process unit 50M contains the exposure pattern QY. Thereby, some toner, which has not been transferred to the photoconductive body 51 of the process unit 50Y, remaining on the conveyance belt 7 corresponding to the exposure pattern QY even after contacting the photoconductive body 51 of the process unit 50Y is transferred onto the photoconductive body 51 of the process unit 50M.

The printer 100 (more specifically, the controller 30) controls the transferer 55 of the process unit 50M not to apply a transfer bias for a period of time when the toner image formed in accordance with the exposure pattern QY is passing through the contact range of the process unit 50M. Thereby, power consumption is reduced.

The exposure pattern M for the process unit 50M does not contain the exposure pattern QC. Therefore, only very little toner of a black toner image formed in accordance with the exposure pattern QC may be transferred onto the photoconductive body 51 of the process unit 50M. The printer 100 (more specifically, the controller 30) applies, to the transferer 55 of the process unit 50M, a transfer bias having a less absolute value than when printing is performed on a sheet, for a period of time when the toner image formed in accordance with the exposure pattern QC is passing through the process unit 50M. Consequently, toner on the exposure pattern QM on the conveyance belt 7 is transferred to the photoconductive body 51 of the process unit 50M. It results in a reduced amount of toner in positions corresponding to the exposure pattern QM on the conveyance belt 7 at a third stage (III) shown in FIG. 9.

The black toner image on the conveyance belt 7 is further conveyed, and comes into contact with the photoconductive body 51 of the process unit 50C in the contact range of the process unit 50C. At this time, the photoconductive body 51 of the process unit 50C has been exposed in accordance with the exposure pattern C for the process unit 50C containing the exposure patterns QY, QM and QC (see FIG. 8). Accordingly, most toner of the black toner image formed in accordance with the exposure pattern QC is transferred onto the photoconductive body 51 of the process unit 50C.

The exposure pattern of the process unit 50C contains the exposure patterns QY and QM. Some toner remaining on the conveyance belt 7 corresponding to the exposure patterns QY and QM even after contacting the photoconductive body 51 of the process units 50Y and 50M is transferred to the photoconductive body 51 of the process unit 50C. At a fourth stage (IV) shown in FIG. 9, most toner of the black toner image on the conveyance belt 7 has been transferred to at least one photoconductive body 51 of the process units 50Y, 50M and 50C, and it results in only very little amount of toner remaining on the conveyance belt 7. Toner still remaining on the conveyance belt 7 even after contacting the photoconductive body 51 of the process unit 50C is removed by the belt cleaner 9.

Thereby, the printer 100 (more specifically, the controller 30) transfers the toner image formed by the process unit 50K onto the photoconductive body 51 of each of the other process units 50Y, 50M, and 50C at such timing that each process unit 50Y, 50M, and 50C is not performing printing on a sheet (e.g., at such timing that the space between two sequentially-fed sheets passes through the contact range of each process unit 50Y, 50M, and 50C). Then, in each of the process units 50Y, 50M, and 50C, the toner image transferred on the photoconductive body 51 is scraped by the cleaner 56. Therefore, toner is supplied to the contact portion between the cleaner 56 and the photoconductive body 51 thereby preventing squeaking.

Subsequently, an explanation will be provided of timing for performing the toner supply operation. As described above, the printer 100 may consecutively perform monochrome printing while the developers 54 of the process units 50Y, 50M, and 50C are detached from the printer 100. When the developers 54 of the process units 50Y, 50M, and 50C are detached from the printer 100, the printer 100 performs the above-described toner supply operation for each monochrome printing on each single sheet.

In a case where the developers 54 of the process units 50Y, 50M, and 50C are attached to the printer 100, when monochrome printing is consecutively performed, an amount of toner remaining between the cleaner 56 and the photoconductive body 51 of each of the process units 50Y, 50M, and 50C tends to decrease. Hence, the printer 100 performs the above-described toner supply operation only when monochrome printing is consecutively performed on a threshold number of sheets. Thereby, the printer 100 may consume a less amount of toner for the toner supply operation rather than monochrome printing on each single sheet. The threshold number may be a fixed number of 2 to 100, and may be stored in the ROM 32 or the NVRAM 34.

For instance, when the fixed number is four (4), and the printer receives a print instruction to perform a fifth consecutive monochrome printing after completed color printing, the printer 100 performs the toner supply operation between the fourth sheet and the fifth sheet. FIG. 10 is a timing chart showing timings to apply a transfer bias to the transferer 55 of each process unit 50K, 50Y, 50M, and 50C and to apply a belt cleaning bias to the belt cleaner 9. As shown in FIG. 10, the transfer bias is applied for printing on a sheet for a time period t1. The transfer bias is not applied for a time period t2 while not performing printing on a sheet. The time period t2 may be between timing when a trailing edge of a preceding sheet passes through one process unit and timing when a leading edge of a following sheet passes through the one process unit. Further, the time period t2 may be for preparation for printing.

The threshold number is not limited to a fixed value. The threshold number may be a variable value depending on print data for printing on sheets and/or an environmental temperature. For instance, after color images have been printed with a larger amount of toner, the threshold number may be set to a larger value than after text images have been printed with a smaller amount of toner. Further, for instance, even though the developers 54 of the process units 50Y, 50M, and 50C are not attached to the printer 100, the printer 100 may perform the toner supply operation each time a threshold number of sheets are consecutively printed.

Meanwhile, when the printer 100 performs color printing, each of the process units 50Y, 50M, and 50C as well as the process unit 50K performs regular toner image formation. Therefore, even after each toner image has been transferred onto a sheet, some toner is likely to remain on each photoconductive body 51. The remaining toner may be substantially removed from each photoconductive body 51 by each cleaner 56, and may function as a lubricant for each cleaner 56. Namely, the printer 100 does not need to perform the above-described toner supply operation.

A sheet with a black toner image transferred thereon by the process unit 50K sequentially comes into contact with other photoconductive bodies 51 in the respective contact ranges of the process units 50Y, 50M, and 50C. In monochrome printing as well, the printer 100 controls the motors 61 to rotate the respective photoconductive bodies 51 of the process units 50Y, 50M, and 50C, and applies the transfer bias to the respective transferers 55 of the process units 50Y, 50M, and 50C. Thereby, the black toner image formed on the sheet may not be distorted while the sheet is conveyed to the process units 50Y, 50M and 50C. When a space between two sequentially-fed sheets where the toner supply operation is not performed passes through the contact range of each process unit 50K, 50Y, 50M, and 50C, the printer 100 may or may not apply the transfer bias to the transferer 55 of each process unit 50K, 50Y, 50M, and 50C.

In the toner supply operation, the printer 100 applies the transfer bias to the transferer 55 of the process unit 50K thereby transferring the black toner image onto the conveyance belt 7. Meanwhile, the printer 100 does not apply the transfer bias to any of the transferers 55 of the other process units 50Y, 50M, and 50C. Accordingly, as indicated by an alternate long and short dash line in FIG. 10, the black toner image transferred onto the conveyance belt 7 by the process unit 50K sequentially comes into contact with the respective photoconductive bodies 51 of the process units 50Y, 50M, and 50C whereby the black toner is transferred to the photoconductive bodies 51.

As described above, the printer 100 of the illustrative embodiment includes the process units 50K, 50Y, 50M, and 50C, and is configured to supply black toner from the process unit 50K to the other process units 50Y, 50M, and 50C. In order to supply toner to the other process units 50Y, 50M, and 50C, the printer 100 (more specifically, the controller 30) controls the process unit 50K (i.e., the toner supply source) to form a toner image based on the first exposure pattern and transfer the toner image onto the conveyance belt 7. Further, the printer 100 controls each of the process units 50Y, 50M, and 50C (i.e., the toner supply destinations) to form an electrostatic latent image on the photoconductive body 51 and convey the electrostatic latent image to the contact range without developing the electrostatic latent image with toner (i.e., while maintaining an undeveloped state of the electrostatic latent image), such that the electrostatic latent image is positionally coincident with the toner image on the conveyance belt 7 in the contact range. Thereby, in the contact range, an electric field is formed due to an electrical potential difference in the boundary between the exposed areas and the unexposed areas of the electrostatic latent image. Thus, black toner of the black toner image is transferred from the conveyance belt 7 onto the photoconductive body 51 by the electric field. Namely, without having to apply a reverse transfer bias, the black toner is transferred from the conveyance belt 7 to the photoconductive body 51 of the process units 50Y, 50M, and 50C. The toner is transferred from one process unit to another process unit regardless of whether the printer 100 includes a power supply for reverse transfer bias.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

[Modifications]

Aspects of the present disclosure may be applied to various apparatuses having a plurality of electrophotographic process units, such as copy machines, multi-function peripherals, and facsimile machines, as well as printers.

In the aforementioned illustrative embodiment, the exposure device 6 having a single light source is used in common by the process units 50K, 50Y, 50M, and 50C. However, the printer 100 may include four light sources for the process units 50K, 50Y, 50M, and 50C. Each of the four light sources may be a laser diode or an LED array. Further, aspects of the present disclosure may be applied to an intermediate transfer type printer that includes an intermediate transfer member and superimpose toner images of different colors on the intermediate transfer member, as well as a direct transfer type printer. When aspects of the present disclosure are applied to the intermediate transfer type printer, the intermediate transfer member may be an endless belt according to aspects of the present disclosure.

Further, the process units 50K, 50Y, 50M, and 50C may be arranged in an order different from the example shown in FIG. 1. For instance, the process unit 50K for black may be disposed downstream of the other process units 50Y, 50M, and 50C in the moving direction of the conveyance belt 7. In this case, the controller 30 of the printer 100 may control the belt cleaner 9 not to perform a cleaning operation. Specifically, the controller 30 may control the process unit 50K, which is the most downstream one of the process units 50K, 50Y, 50M, and 50C, to transfer a toner image onto the conveyance belt 7, and then may convey the toner image to the respective contact ranges of the other process units 50Y, 50M, and 50C while controlling the belt cleaner 9 not to perform a cleaning operation. In this case, operations by the other process units 50Y, 50M, and 50C may be substantially the same as exemplified in the aforementioned illustrative embodiment.

Further, aspects of the present disclosure maybe applied to printers using negatively-chargeable toner, as well as printers using positively-chargeable toner. When aspects of the present disclosure are applied to a printer using negatively-chargeable toner, each bias may be applied with a polarity opposite to the polarity exemplified in the aforementioned illustrative embodiment.

In the aforementioned illustrative embodiment, when a single space between two sequentially-fed sheets sequentially passes through the contact range of each of the process units 50Y, 50M, and 50C, toner is sequentially supplied to each of the process units 50Y, 50M, and 50C. However, for instance, toner may be supplied to a process unit when a space between adjacent two preceding sheets passes through the contact range of the process unit, and toner may be supplied to a different process unit when another space between adjacent two subsequent sheets passes through the contact range of the different process unit. Further, the toner supply source may be a process unit other than the process unit 50K.

Further, for instance, the constant-voltage element 552 may not necessarily be provided. Nonetheless, when the constant-voltage element 552 is provided, it is possible to stabilize the electrical potential of the transfer roller 551.

In the aforementioned illustrative embodiment, the second exposure pattern has the total width of the unexposed areas 51A be equal to or more than the total width of the exposed areas 51B in the main scanning direction. Nonetheless, in the second exposure pattern, the total width of the unexposed areas 51A may be equal to the total width of the exposed areas 51B in the main scanning direction. Further, the total width of the exposed areas 51B may be more than the total width of the unexposed areas 51A in the main scanning direction. In this respect, however, it is preferable that the total width of the unexposed areas 51A is equal to or more than the total width of the exposed areas 51B in the main scanning direction. This is because a greater width of the unexposed areas 51A is more beneficial for supplying an adequate amount of toner to the toner supply destination.

In the aforementioned illustrative embodiment, a development bias having an electric potential with a larger absolute value is applied to the developer 54 of the process unit 50K in the toner supply operation than when printing is performed on a sheet. Nonetheless, a development bias with the same absolute value as when printing is performed on a sheet may be applied to the developer 54 of the process unit 50K in the toner supply operation. Further, in the aforementioned illustrative embodiment, a less transfer current or a transfer bias having a less absolute value may be applied to the transferer 55 of the process unit 50K in the toner supply operation, than when printing is performed on a sheet. Nonetheless, the same transfer current or a transfer voltage having the same absolute value as when printing is performed on a sheet may be applied to the transferer 55 of the process unit 50K in the toner supply operation.

The operations and/or the processes exemplified in the aforementioned illustrative embodiment may be performed by one or more hardware elements such as a single CPU, a plurality of CPUs, one or more ASICs, and a combination of one or more CPUs and one or more ASICs. The operations and/or the processes exemplified in the aforementioned illustrative embodiment may be implemented in various aspects such as methods and computer programs stored in computer-readable media.

What is claimed is:

1. An image forming apparatus comprising:

a belt;

a first process unit comprising:

a first photoconductive body;

a first charger configured to charge a surface of the first photoconductive body;

a first exposure device configured to expose the charged surface of the first photoconductive body thereby forming an electrostatic latent image on the surface of the first photoconductive body;

a first developer configured to develop, with toner, the electrostatic latent image formed on the surface of the first photoconductive body thereby forming a toner image on the surface of the first photoconductive body; and a first transferer configured to transfer, onto the belt, the toner image formed on the surface of the first photoconductive body;

a second process unit comprising:

a second photoconductive body disposed downstream of the first photoconductive body in a moving direction of the belt;

a second charger configured to charge a surface of the second photoconductive body;

a second exposure device configured to expose the charged surface of the second photoconductive body;

a second developer; and a second transferer opposed to the second photoconductive body across the belt in a contact position where the second photoconductive body contacts the belt; and a controller configured to perform a toner supply operation to supply toner from the first process unit to the second process unit, the toner supply operation comprising:

controlling the first charger to charge the surface of the first photoconductive body;

controlling the first exposure device to expose the charged surface of the first photoconductive body in accordance with a first pattern thereby forming a first electrostatic latent image based on the first pattern on the surface of the first photoconductive body;

controlling the first developer to develop the first electrostatic latent image with toner thereby forming a specific toner image based on the first pattern on the surface of the first photoconductive body;

controlling the first transferer to transfer the specific toner image onto the belt;

controlling the second charger to charge the surface of the second photoconductive body;

controlling the second exposure device to expose the charged surface of the second photoconductive body in accordance with a second pattern thereby forming a second electrostatic latent image based on the second pattern on the surface of the second photoconductive body; the second pattern comprising an exposed area and an unexposed area;

controlling the second developer to not develop the second electrostatic latent image with toner, thereby allowing the second electrostatic latent image to be conveyed to the contact position such that the second electrostatic latent image positionally coincides, in the contact position, with the specific toner image transferred onto the belt, and while conveying the second electrostatic latent image to the contact position, not applying a transfer bias to the second transferer, in such a manner that when the second electrostatic latent image positionally coincides, in the contact position, with the specific toner image transferred onto the belt, the toner of the specific toner image is transferred onto the exposed area due to an electric field generated between the unexposed area and the exposed area.

2. The image forming apparatus according to claim 1, wherein the second process unit further comprises a cleaner configured to contact the surface of the second photoconductive body in a cleaning position, the cleaning position being downstream of the contact position in a rotational direction of the second photoconductive body, the cleaning position being upstream of a charge position where the second charger charges the surface of the second photoconductive body in the rotational direction, and wherein when the second electrostatic latent image on the second photoconductive body is conveyed to the contact position without being developed with toner, at least a part of the specific toner image on the belt is transferred onto the second photoconductive body, and supplied to the cleaning position.

3. The image forming apparatus according to claim 1, wherein a width of the unexposed area in a main scanning direction is equal to or more than a width of the exposed area in the main scanning direction.

4. The image forming apparatus according to claim 1, wherein a width of the second pattern in a sub scanning direction is less than a width of a nip between the second photoconductive body and the belt in the contact position of the second process unit.

5. The image forming apparatus according to claim 1, wherein an exposed area of the first pattern is identical to an exposed area of the second pattern.

6. The image forming apparatus according to claim 1, wherein an exposed area of the first pattern is wider than an exposed area of the second pattern.

7. The image forming apparatus according to claim 1, further comprising:

a third process unit comprising:

a third photoconductive body disposed downstream of the second photoconductive body in the moving direction of the belt;

a third charger configured to charge a surface of the third photoconductive body;

a third exposure device configured to expose the charged surface of the third photoconductive body;

a third developer; and a third transferer opposed to the third photoconductive body across the belt in a contact position where the third photoconductive body contacts the belt, wherein the controller is further configured to:

control the third charger to charge the surface of the third photoconductive body;

control the third exposure device to expose the charged surface of the third photoconductive body in accordance with a third pattern thereby forming a third electrostatic latent image based on the third pattern on the surface of the third photoconductive body; and control the third developer to not develop the third electrostatic latent image with toner, thereby allowing the third electrostatic latent image to be conveyed to the contact position of the third process unit such that the third electrostatic latent image positionally coincides, in the contact position of the third process unit, with the specific toner image transferred onto the belt.

8. The image forming apparatus according to claim 7, wherein the third process unit further comprises a cleaner configured to contact the surface of the third photoconductive body in a cleaning position, the cleaning position of the third process unit being downstream of the contact position of the third process unit in a rotational direction of the third photoconductive body, the cleaning position of the third process unit being upstream of a charge position where the third charger charges the surface of the third photoconductive body in the rotational direction of the third photoconductive body, and wherein when the third electrostatic latent image on the third photoconductive body is conveyed to the contact position of the third process unit without being developed with toner, at least a part of the specific toner image on the belt is transferred onto the third photoconductive body, and supplied to the cleaning position of the third process unit.

9. The image forming apparatus according to claim 1, wherein the second process unit further comprises a constant-voltage element electrically connected with the second transferer, the second transferer being grounded via the constant-voltage element.

10. The image forming apparatus according to claim 1, further comprising:

an intermediate process unit comprising:

an intermediate photoconductive body disposed downstream of the first photoconductive body and upstream of the second photoconductive body in the moving direction of the belt; and an intermediate transferer opposed to the intermediate photoconductive body across the belt in an intermediate contact position where the intermediate photoconductive body contacts the belt, wherein the controller is further configured to, while the specific toner image transferred onto the belt is passing through the intermediate process unit, apply to the intermediate transferer a transfer bias, the transfer bias being one of a transfer current and a transfer voltage having a lesser absolute value than when printing is performed on a sheet.

11. The image forming apparatus according to claim 1, further comprising:

a downstream process unit comprising:

a downstream photoconductive body disposed downstream of the second photoconductive body in the moving direction of the belt; and a downstream transferer opposed to the downstream photoconductive body across the belt in a downstream contact position where the downstream photoconductive body contacts the belt, wherein the controller is further configured to, while the specific toner image transferred onto the belt is passing through the downstream process unit, not apply to the downstream transferer a transfer bias.

12. The image forming apparatus according to claim 1, wherein the controller is further configured to, while controlling the first developer to develop the first electrostatic latent image with toner, apply to the first developer a development bias, the developing bias having an electric potential with a larger absolute value than when printing is performed on a sheet.

13. The image forming apparatus according to claim 1, wherein the controller is further configured to, while controlling the first transferer to transfer the specific toner image onto the belt, apply to the first transferer a transfer bias, the transfer bias being one of a transfer current and a transfer voltage having a lesser absolute value than when printing is performed on a sheet.

14. The image forming apparatus according to claim 1, wherein the controller is further configured to, when monochrome printing is consecutively performed on more than a threshold number of sheets by the first process unit, perform the toner supply operation.

15. The image forming apparatus according to claim 1, wherein the controller comprises:

a processor; and a memory storing processor-executable instructions configured to, when executed by the processor, cause the processor to perform the toner supply operation.

16. A method adapted to be implemented on a processor coupled with an image forming apparatus comprising a belt, a first process unit, and a second process unit, the method comprising:

controlling a first charger of the first process unit to charge a surface of a first photoconductive body of the first process unit;

controlling a first exposure device of the first process unit to expose the charged surface of the first photoconductive body in accordance with a first pattern thereby forming a first electrostatic latent image based on the first pattern on the surface of the first photoconductive body;

controlling a first developer of the first process unit to develop the first electrostatic latent image with toner thereby forming a specific toner image based on the first pattern on the surface of the first photoconductive body;

controlling a first transferer of the first process unit to transfer the toner image onto the belt;

controlling a second charger of the second process unit to charge a surface of a second photoconductive body of the second process unit;

controlling a second exposure device of the second process unit to expose the charged surface of the second photoconductive body in accordance with a second pattern thereby forming a second electrostatic latent image based on the second pattern on the surface of the second photoconductive body, the second pattern comprising an exposed area and an unexposed area;

controlling a second developer of the second process unit to not develop the second electrostatic latent image with toner, thereby allowing the second electrostatic latent image to be conveyed to a contact position, where the second photoconductive body contacts the belt, such that the second electrostatic latent image positionally coincides, in the contact position, with the toner image transferred onto the belt, and while conveying the second electrostatic latent image to the contact position, not applying a transfer bias to a second transferer opposed to the second photoconductive body across the belt, in such a manner that when the second electrostatic latent image positionally coincides, in the contact position, with the specific toner image transferred onto the belt, the toner of the specific toner image is transferred onto the exposed area due to an electric field generated between the unexposed area and the exposed area.

17. A non-transitory computer-readable medium storing computer-readable instructions that are executable by a processor coupled with an image forming apparatus, the image forming apparatus comprising a belt, a first process unit, and a second process unit, the instructions being configured to, when executed by the processor, cause the processor to:

control a first charger of the first process unit to charge a surface of a first photoconductive body of the first process unit;

control a first exposure device of the first process unit to expose the charged surface of the first photoconductive body in accordance with a first pattern thereby forming a first electrostatic latent image based on the first pattern on the surface of the first photoconductive body;

control a first developer of the first process unit to develop the first electrostatic latent image with toner thereby forming a specific toner image based on the first pattern, on the surface of the first photoconductive body;

control a first transferer of the first process unit to transfer the toner image onto the belt;

control a second charger of the second process unit to charge a surface of a second photoconductive body of the second process unit;

control a second exposure device of the second process unit to expose the charged surface of the second photoconductive body in accordance with a second pattern thereby forming a second electrostatic latent image based on the second pattern on the surface of the second photoconductive body, the second pattern comprising an exposed area and an unexposed area;

control a second developer of the second process unit to not develop the second electrostatic latent image with toner, thereby allowing the second electrostatic latent image to be conveyed to a contact position, where the second photoconductive body contacts the belt, such that the second electrostatic latent image positionally coincides, in the contact position, with the toner image transferred onto the belt; and while conveying the second electrostatic latent image to the contact position, not applying a transfer bias to a second transferer opposed to the second photoconductive body across the belt, in such a manner that when the second electrostatic latent image positionally coincides, in the contact position, with the specific toner image transferred onto the belt, the toner of the specific toner image is transferred onto the exposed area due to an electric field generated between the unexposed area and the exposed area.

* * * * *